US005522098A

United States Patent [19]

Podgorschek

[11] Patent Number: 5,522,098

[45] Date of Patent: Jun. 4, 1996

[54] PARTURITION BED

[75] Inventor: Iris Podgorschek, Vienna, Austria

[73] Assignee: Karin Berghammer, Austria

[21] Appl. No.: 240,758

[22] PCT Filed: Nov. 12, 1992

[86] PCT No.: PCT/AT92/00145

§ 371 Date: May 12, 1994

§ 102(e) Date: May 12, 1994

[87] PCT Pub. No.: WO93/09750

PCT Pub. Date: May 27, 1993

[30] Foreign Application Priority Data

| | | | |
|---|---|---|---|
| Nov. 12, 1991 | [AT] | Austria | 2233/91 |
| Jul. 20, 1992 | [AT] | Austria | 1478/92 |

[51] Int. Cl.[6] ..... A61G 7/00

[52] U.S. Cl. ..... 5/602; 5/611; 5/613

[58] Field of Search ..... 5/602, 611, 612, 5/613, 614, 617

[56] References Cited

U.S. PATENT DOCUMENTS

| | | | |
|---|---|---|---|
| 2,306,031 | 12/1942 | Anderson et al. | 5/602 |
| 2,832,655 | 4/1958 | Adolphson . | |
| 3,694,830 | 10/1972 | Koller | 5/611 X |
| 4,139,917 | 2/1979 | Fenwick . | |
| 4,270,233 | 6/1981 | Mulligan | 5/602 |
| 4,435,861 | 3/1984 | Lindley | 5/613 X |
| 4,615,058 | 10/1986 | Feldt . | |
| 4,682,376 | 7/1987 | Feldt . | |
| 4,894,876 | 1/1990 | Fenwick | 5/602 |
| 5,157,800 | 10/1992 | Borders | 5/602 |

FOREIGN PATENT DOCUMENTS

| | | |
|---|---|---|
| 8326375 | 1/1977 | Australia . |
| 0136419 | 4/1985 | European Pat. Off. . |
| 0491165 | 6/1992 | European Pat. Off. . |
| 636085 | 3/1928 | France . |
| 8806419 | 1/1965 | Germany . |
| 497662 | 12/1938 | United Kingdom . |

*Primary Examiner*—Michael F. Trettel
*Attorney, Agent, or Firm*—Ostrolenk, Faber, Gerb & Soffen

[57] ABSTRACT

A parturition bed having a lying surface (1) transversely divided into two mutually adjustable parts has a main supporting part (2) and a leg supporting part (3) that may be adjusted from a common lying plane into planes approximately parallel to the lying plane located at different heights with respect to each other. The leg supporting part (3) can be moved when in a lowered position in relation to the main supporting part (2)in the longitudinal direction of the parturition bed into a free space located below the main supporting part (2), at least in the pelvis supporting area of the latter.

In order to allow the parturient to take any desired position, including a vertical position, during childbirth, while ensuring easy access to the doctor and midwife, the main supporting part (2) is supported on an overhanging beam (6) with relation to a main stay (5) arranged at the head end of the main supporting part (2) and supported on the floor (4), and can be lifted into a higher position and lowered back again by an adjusting mechanism (8, 9, 11, 12, 13).

18 Claims, 3 Drawing Sheets

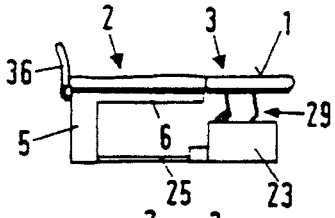
FIG.5A
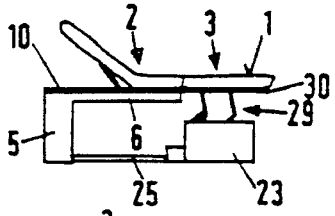
FIG.5B
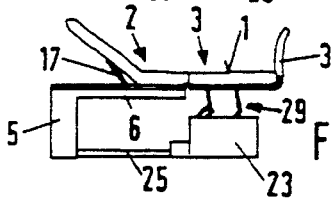
FIG.5C
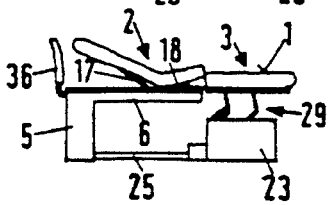
FIG.5D
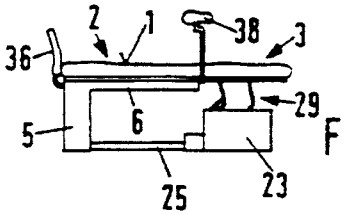
FIG.5E
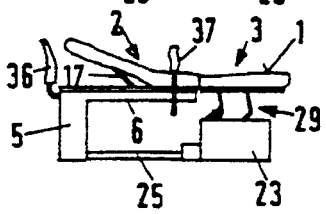
FIG.5F
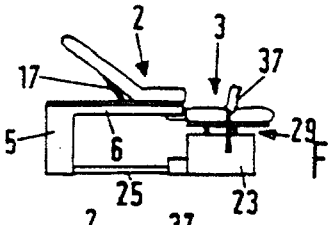
FIG.6A
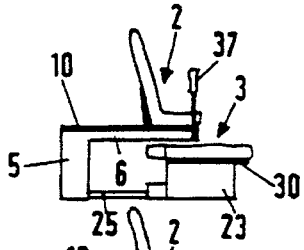
FIG.6B
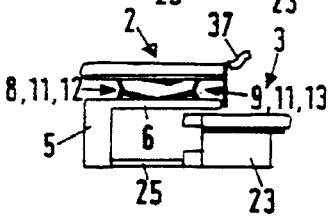
FIG.6C
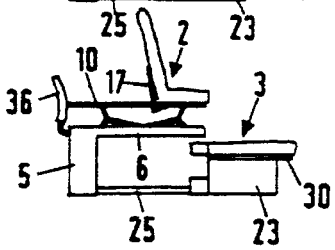
FIG.6D
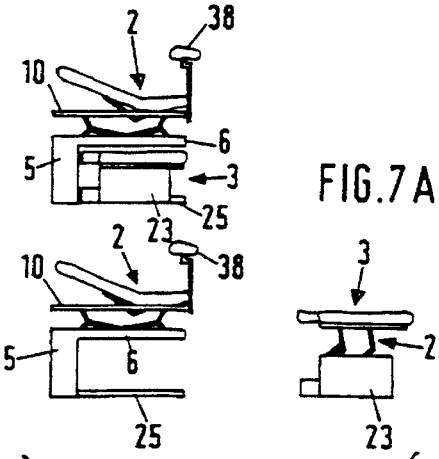
FIG.7A
FIG.7B
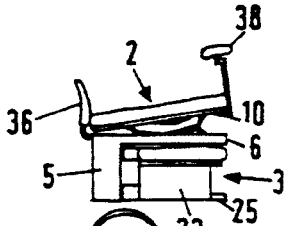
FIG.7C
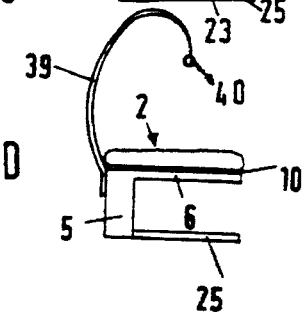
FIG.7D

PARTURITION BED

BACKGROUND OF THE INVENTION

1. Field of the Invention

The invention concerns a parturition bed with a lying surface transversely divided into two mutually adjustable parts, i.e. a main supporting part providing support for the pelvis and upper part of the body of the parturient, and a leg supporting part providing support for her legs. Both the main supporting part and the leg supporting part may be adjusted from the specified height of their common lying plane to positions roughly parallel to this lying plane and at varying heights with respect to one another, i.e. a mechanism allows the leg supporting part to be lowered and raised. When the leg supporting part is in a lowered position in relation to the main supporting part, it can be slid into the free space below the main supporting part, at least as far in as the pelvis supporting portion of the latter, and in the longitudinal direction of the parturition bed.

2. Description of the Related Art

Simple parturition beds exist, e.g. in form of the U.S. Pat. No. 4,615,058, the EP-A- 0 136 419, the U.S. Pat. No. 4,682,376 and the DE-GM- 88 06419.

The U.S. Pat. No. 2,832,655 deals with a parturition bed of the kind described above; the leg supporting part can be lowered to a level immediately below that of the main supporting part and in this lowered position can be slid underneath the main supporting part, making it possible to use the parturition bed as a gynaecological chair. The AU-A - 8 326 375 discloses a very similar kind of bed.

Common to all the existing beds or parturition beds is the fact that the parturient is only able to assume a lying or half sitting position.

However, rediscovered knowledge shows that a vertical position and movement during the process of delivery entail a number of advantages from a medical point of view, as well as allowing the parents-to-be a more conscious experience of birth.

Up until today, it was necessary to improvise on ground level— usually with the help of mattresses and stools—to allow such an upright parturition position and the integration of the partner. Doctor and midwife had to assume comparatively strenuous postures to attend to a birth in any other position than one which had the parturient lying down.

The earlier EP-A-0 491 165, which was, however, published subsequently to this, describes a parturition bed also consisting of a main supporting part and a leg supporting part whose height can be adjusted in relation to one another. However, the leg supporting part can only be slid underneath the main supporting part when the former is in a fully lowered position. The leg supporting part can only be arrested at one particular level, i.e. it cannot be adjusted to intermediary levels between its highest and lowest position. This makes it difficult for the parturient to assume a squatting position, which, if at all, can only be achieved near floor level, making it necessary for the doctor or midwife to stoop while attending to the delivery.

In a semi-lowered position—which would enable the parturient to assume a squatting position at a higher level—the leg supporting part cannot be slid underneath the main supporting part as this is prevented by the height adjustment mechanism of the main supporting part which is shaped like a pillar and extends into the pelvis supporting portion of the main supporting part. Therefore the leg supporting part juts out and seriously impedes access, i.e. doctor or midwife have to lean over the protruding end of the leg supporting part.

Conversely, the specifications of the invention at hand place the main stay at the head end of the main supporting part, thereby creating a free space underneath the latter, permitting the leg supporting part to be slid under the main supporting part irrespective of the level the leg supporting part has been lowered to.

SUMMARY OF THE INVENTION

The purpose of this invention is to create a parturition bed which meets the new requirements of natural obstetrics including the option of an upright position during delivery, i.e. allowing the parturient a greater freedom of choice regarding her position, and making it possible to integrate the partner while at the same time ensuring ideal access to the attending doctor or midwife. In addition, should medical intervention become necessary, the bed is designed to be rapidly turned into an operating table.

The invention achieves this dual purpose by having the main supporting part rest on an overhanging beam fixed to a main stay located at the head end of the main supporting part and connecting it to the floor. An adjustment mechanism allows the main supporting part to be raised from the specified lying plane and lowered back again—independently of the leg supporting part.

The specifications of the parturition bed described in this invention allow its two main parts to be arranged in such a way as to create two planes with a variable difference in height level. This permits the parturient to assume a sitting position as well as a squatting position at the lower level, either by herself or leaning against, and supported by, the legs of the partner sitting behind her on the upper level. The difference in height level is in the order of 50 cm. In this context, it is essential that the leg supporting part can be partly slid underneath the main supporting part to ensure ease of frontal access.

To ensure optimal flexibility, preferably both the main supporting part and the leg supporting part are adjustable steplessly and in an infinitely variable manner.

An efficient and space-saving construction allows the main supporting part to be raised, lowered and inclined in relation to the beam resting on the main stay; in a lowered position the leg supporting part should slide under the beam supporting the main supporting part.

To allow the parturient to lie at an oblique angle in relation to the plane of the lying surface, the adjustment mechanism permits the main supporting part to be inclined at varying angles.

To be able to turn the parturition bed into a gynaecological chair, a preferred design variant includes a main supporting part subdivided into two jointed sections, a back section and a pelvis section, which can separately be inclined at varying angles.

To ensure the definite orientation of the leg supporting part with respect to the main supporting part, the leg supporting part moves along a guide rail extending from the main stay in the direction of the overhanging beam which supports the main supporting part.

An additional preferred design variant is distinguished by the option of completely separating the leg supporting part and the main supporting part, in which case swivel-arms connect the leg supporting part to a supporting frame separate from the main stay of the main supporting part.

To facilitate the sitting and squatting positions, the end of the leg supporting part facing the main supporting part is equipped with a protruding, convex, preferably semi-circular, section which fits into a corresponding concave indentation in the main supporting part, provided that the main supporting part and the leg supporting part are arranged at the same height.

The versatility and universal usability of the parturition bed are enhanced by including into the design a detachable rest which can be attached to the head end of the main supporting part, preferably at the height of the beam which supports the main supporting part, as well as to the foot end of the leg supporting part; in addition, supporting hand-grip rests and/or leg rests which can be alternatively attached to the main supporting part and/or the leg supporting part can also be added.

To adjust and fix the position of the leg supporting part in relation to the main supporting part, the leg supporting part runs along the guide rail on guide rollers, and can be firmly connected to the guide rail through the use of brake shoes gripping the guide rail. The guide rail should function as an energy supply line, preferably as a low-voltage conductor, for the energy supply of the adjustment mechanism of the leg supporting part.

The independent movability of the leg supporting part is ensured by having the supporting frame of the leg supporting part rest on the floor on supporting rollers attached to the frame; the supporting rollers are pivoting rollers which can be locked in place.

To ensure stepless adjustability both the main supporting part and the leg supporting part are equipped with their own electrically operated hydraulic unit.

A simple construction that allows the main supporting part to be raised, lowered and inclined, is distinguished by the incorporation into the main supporting part of an underframe which can be raised and lowered in relation to the supporting beam, and which is jointed to the latter by a pair of toggles, located at opposite ends of the main supporting part; jointed to the central joint at the bend of each toggle is a separate hydraulic cylinder which is in turn jointed to the supporting beam or to the underflame.

BRIEF DESCRIPTION OF THE DRAWINGS

In the following, the invention is described in greater detail utilizing the graphic depiction of a representative design variant:

FIGS. 5A to 5F show schematic side views of the parturition bed according to an embodiment of the present invention depicting the parturition bed in various configurations, all of them, however, with the main supporting part and the leg supporting part at a common height level.

FIGS. 6A to 6D represent configurations of the parturition bed according to an embodiment of the present invention with the main supporting part and the leg supporting part at different height levels in respect to one another.

FIGS. 7A to 7D depict the independent use of either the main supporting part alone, or the main supporting part apart from the leg supporting part according to an embodiment of the present invention.

DETAILED DESCRIPTION OF THE PREFERRED EMBODIMENTS

The parturition bed specified in this invention includes a lying surface 1, which is made up of two mutually adjustable parts, i.e. a main supporting part 2, upon which a parturient lying on the lying surface 1 can rest the upper part of her body and her pelvis, and a leg supporting part 3, which provides support for her legs.

Figure 4:
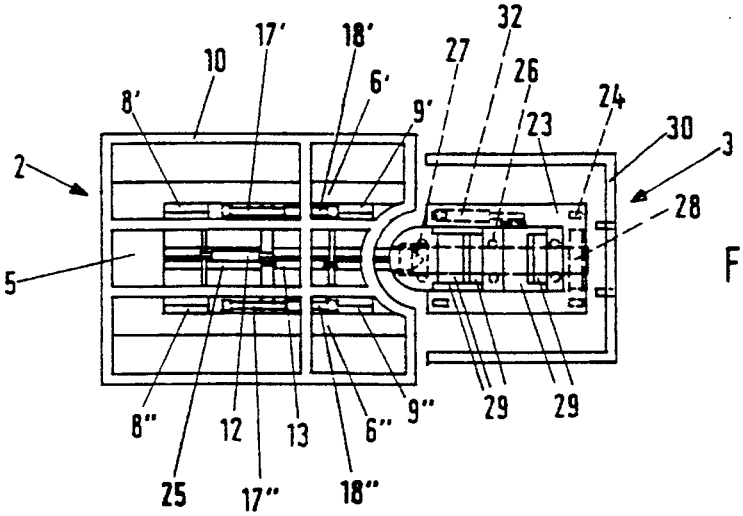
FIG. 4 shows a cross section drawn along the line marked IV—IV in FIG. 1.

The main supporting part 2 is supported by an overhanging beam 6 extending from the main stay 5 which rests on the floor 4. The main stay 5 itself is firmly anchored to the floor 4 by means of the anchorage 7. Jointed to the overhanging beam 6, which, as becomes evident in FIG. 4, consists of two separate parallel supporting arms 6', 6", is one end each of the two toggles 8, 9. The other end of toggles 8 and 9 respectively, is jointed to the underframe 10, which can be raised and lowered in relation to the beam 6. The central joint at the bend 11 of toggles 8 and 9 respectively, is jointed to one end of hydraulic cylinders 12, 13 respectively, whose other end is jointed to beam 6; their operation allows the underframe 10 to be raised and lowered steplessly in respect to beam 6, as can dearly be seen from FIG. 1 and 2 in particular. An uneven use of hydraulic cylinders 12, 13 permits an infinitely variable, stepless inclination of underframe 10 with respect to beam 6, cf e.g. FIG. 7C.

The underframe 10 supports a back section 14 and a pelvis section 15 jointed to one another at 16, and also jointed to underframe 10. Two additional hydraulic cylinders 17, 18 permit an inclination of back section 14 and pelvis section 15 in relation to one another, as well as in relation to underflame 10 (cf FIGS. 5B, 5D). Back section 14 and pelvis section 15 support a mattress of foamed plastics 19 with a plastic covering.

The energy supply of the adjustment mechanism of main supporting part 2 is provided via a power supply line 20 leading into main stay 5. For optimal use of space, the electrically operated hydraulic unit 21, which supplies the hydraulic cylinders, is located inside the main stay 5. The main stay 5 is cased on all sides and equipped with a maintenance hatch 22, to ensure easy access to the hydraulic unit 21. Independently of main supporting part 2, the leg supporting part 3 is supported by a separate supporting frame 23. Similar to the main stay 5, this supporting frame 23 is cased on all sides. Ely means of supporting rollers 24, which take the form of pivoting rollers that can be locked in place, this supporting frame 23 can be moved on the floor 4. To ensure a definite orientation of the leg supporting part with respect to the main supporting part, close to floor level a guide rail 25 extends from the main stay 5 in direction of the overhanging end of the beam 6 and parallel to the latter. The supporting frame 23 of the leg supporting part 3 is connected to the guide rail 25 by means of guiding rollers 26. Brake shoes 27, preferably hydraulically operated, serve to fix leg supporting part 3 in a particular position along guide rail 25.

Guide rail 25 also contains an energy supply line for the power supply of an adjustment mechanism of leg supporting part 3; preferably the guide rail itself functions as a low-voltage conductor for the power supply of an electrically operated hydraulic unit 28, located in the supporting frame 23 of leg supporting part 3.

Supported by the supporting frame 23 via two articulated swivel arms 29, arranged parallel to one another, is a panel 31 surrounded by a rigid frame 30. Swivel arms 29 and, consequently, panel 31 can be raised and lowered by means of a hydraulic cylinder 32. Panel 31 serves to hold a mattress of foamed plastic 33 with a plastic covering.

Figure 1:
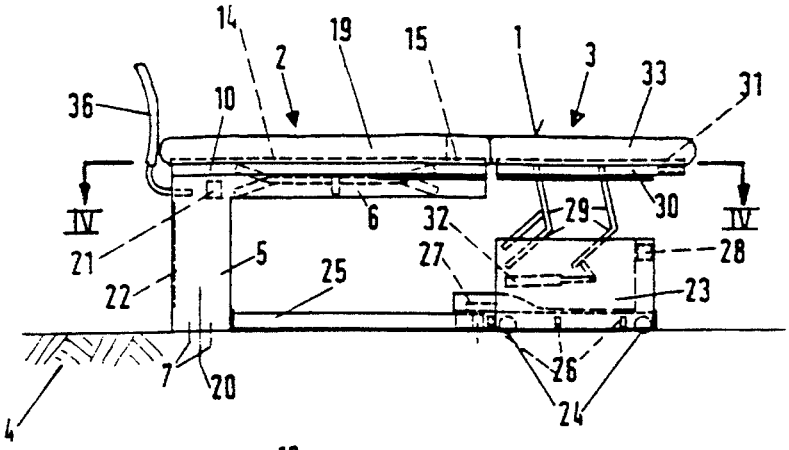
FIG. 1 shows a schematic side view of a parturition bed according to an embodiment of the present invention in a lying position.
Figure 2:
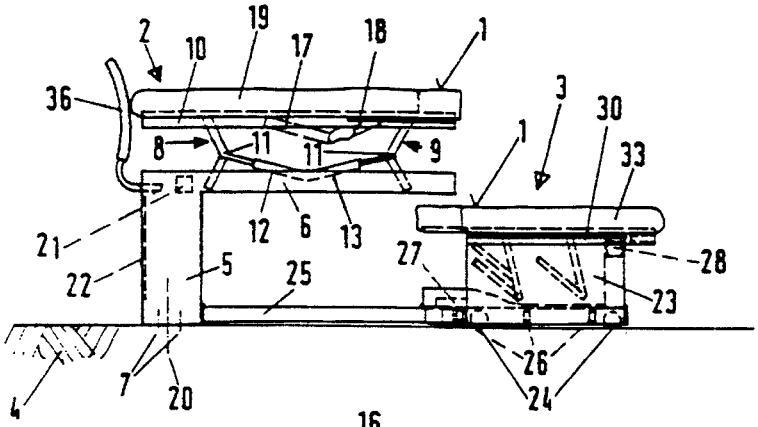
FIG. 2 shows a schematic side view of a parturition bed according to an embodiment of the present invention in a configuration with maximal difference in height level between main supporting part and leg support part.

As can be seen in FIG. 1 and 2, the mattress 33 of the leg supporting part 3 can be raised and lowered steplessly in a horizontal position by means of swivel arms 29.

Figure 3:
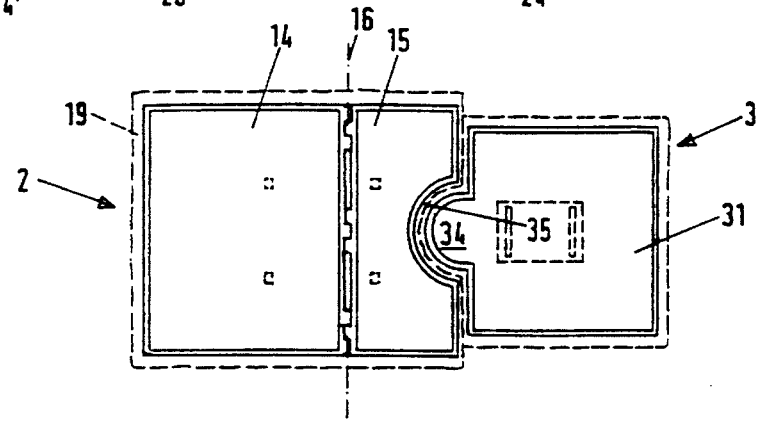
FIG. 3 shows a plan view of the parturition bed, according to an embodiment of the present invention.

As can be seen in FIG. 3, the end of the leg supporting part 3 facing the main supporting part 2 is equipped with a convex, protruding, semi-circular section 34, which fits into a corresponding indentation 35 in the main supporting part 2, provided main supporting part 2 and leg supporting part 3 are arranged at the same height; this results in a unified lying surface 1 irrespective of the indentation described above. A detachable rest 36 can be attached to either the head end of main supporting part 2, at the height of the overhanging beam 6, or the foot end of the leg supporting part 3, specifically to the height-adjustable panel 31 or its rigid frame 30, respectively. In this manner, when the detachable rest 36 is attached to the leg supporting part 3 (cf FIG. 5C), it can be raised and lowered along with the latter's mattress 33. Handgrips 37 and leg rests 38 can be attached to alternatively the main supporting part 2 and/or the leg supporting part 3.

A strut 39 providing support for a hanging grip 40 can be attached to the main stay 5 at the head end of main supporting part 2. The strut 39 extends to a point approximately above the front section (pelvis section 15) of the main supporting part and allows enough space to assume a raised position underneath strut 39.

In the following, the function of the parturition bed is described in greater detail utilizing FIG. 5A to 7D; analogous to FIGS. 9A to 10D, FIGS. 5A to 10D depict the parturition bed including the respective position assumed by the parturient.

Figure 8A:
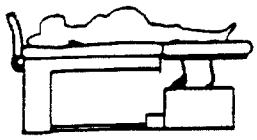
FIGS. 8A to 8F show the practical application of the respective analogous configurations shown in FIGS. 5A—5F.

FIG. 8A: The parturient is able to assume a lying position.

Figure 8B:
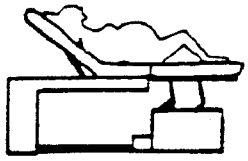

FIG. 8B: The parturient lies with the upper part of her body raised.

Figure 8C:
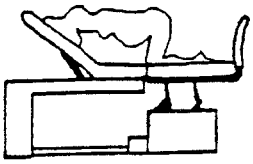

FIG. 8C: The parturient is able to assume a kneeling position during delivery; facing towards back section 14, she supports herself on her hands or lower arms. Medical advantages: avoidance of the vena cava syndrom, optimization of the birth axis, better support of the perineum, reduced pressure on the perineum, fewer episiotomies are necessary, reduced pain, particularly during the transitional period, widening of the parturient canal, advantages in case of shoulder-dystocia . . . The detachable rest 36 is attached to the foot end of leg supporting part 3, and serves as a back rest. In this way, the parturient is able to sit back after birth, and before the baby's umbilical cord is cut, without having to turn around, guaranteeing the highest possible degree of cleanliness.

Figure 8D:
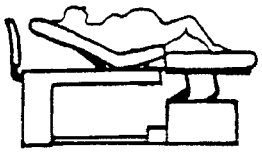

FIG. 8D: The parturient is able to assume a reclining position with her pelvis raised. The semi-circular concave indentation 35 of mattress 19 in the pelvis area provides room for the pelvis and ideal access for the doctor or midwife.

Figure 8E:
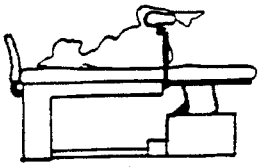

FIG. 8E: Leg rests 38 are attached.

Figure 8F:
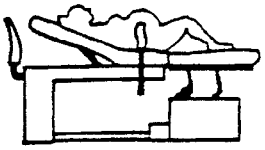

FIG. 8F: Lightly padded hand-grips 37 can either be attached to main supporting part 2 for the use of the hands (cf FIG. 5F), or to the leg supporting part 3 for the use of the parturient's legs (cf FIG. 6A).

Figure 9A:
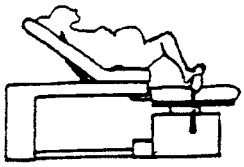
FIGS. 9A to 9D show the practical application of the respective analogous configurations shown in FIGS. 6A to 6D.

FIG. 9A: The parturient is able to assume a half-sitting position with the back section 14 at an angle, and a moderate difference in level between the main supporting part 2 and the leg supporting part 3 of the parturition bed.

Figure 9B:
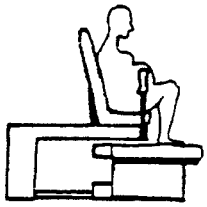

FIG. 9B: The parturient is able to sit on the main supporting part 2 of the parturition bed, with the back section 14 fully raised, and rest her legs on the lowered leg supporting part 3 of the parturition bed. Partly sliding leg supporting part 3 underneath main supporting part 2 ensures optimal access by the doctor or midwife, who are able to attend to the parturient in an upright position. The semi-circular, concave indentation of the mattress of the main supporting part 2 allows the pelvis ample space. Medical advantages: particularly favorable during the expulsion period, gravity-assisted, the head does not slip back in between uterine contractions, quicker progress of labor, decreased risk for the perineum.

Figure 9C:
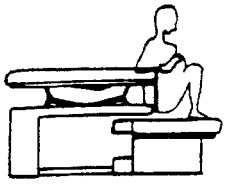

FIG. 9C: The parturient is able to squat on the lowered leg supporting part 3 of the parturition bed, with her elbows resting on mattress 19 of the main supporting part 2, and holding on to the hand-grips 37. As the leg supporting part may be moved along the guide rail, it may be adjusted to ensure an optimal individual distance between the midwife and the parturient. As the leg supporting part can be lowered and raised the height of the parturient can also be taken into consideration.

Medical advantages: particularly advantageous during the expulsion period, grounded by firm planting of feet, gravity-assisted, less strength necessary, optimization of the birth axis, kyphotization of the spine, increased lung capacity, relaxed pelvic floor, pain relief, widening of the pelvic outlet by 1–5 cm, less risk for the perineum, better support of the perineum becomes possible, since doctor and midwife are assured ideal access, quicker progress of labor, decreased secondary uterine insufficency, the child is helped in following the way of least resistance, better oxygen supply for the child, the head does not slip back in between uterine contractions, good access for doctor and midwife.

Figure 9D:
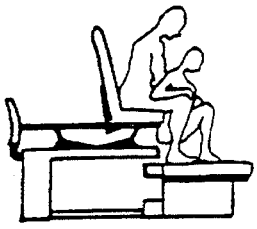

FIG. 9D: The parturient is able to squat on the leg supporting part 3 while leaning against, and supporting herself on, the legs of a partner sitting on main supporting part 2. Medical advantages: as in FIG. 9C; in addition, the integration of the man, the spectator becomes a participant, the parturient feels more secure, consequently more relaxed, thereby aiding the progress of delivery.

Figure 10A:
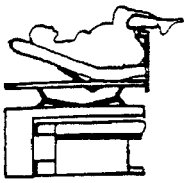
FIGS. 10A to 10D show the practical application of the respective analogous configurations shown in FIGS. 7A to 7D.

FIG. 10A: With the leg supporting part 3 in a lowered position and slid under the main supporting part 2, the parturition bed can easily and under optimal use of available space be converted into a gynaecological chair. If the leg rests 38 are attached, optimal conditions are created for potential interventions, such as caring for episiotomy, manual assistance during breech presentation, forceps- or vacuum extraction.

Figure 10C:
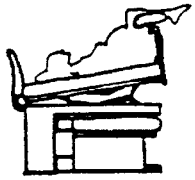
Figure 10B:
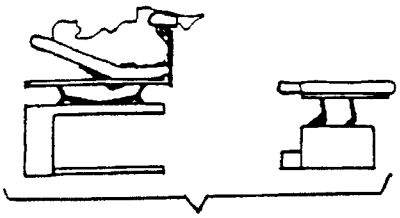

FIG. 10B: The leg supporting part 3 is detached from main supporting part 2 and used separately as a worktop.

FIG. 10C: In case of a prolaps of the umbilical cord the parturient is able to lie at an oblique angle.

Figure 10D:
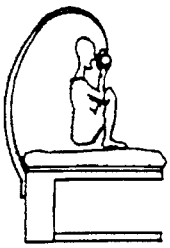

FIG. 10D: The parturient is able to sit or squat on the main supporting part 27, holding on to the hanging grip 40, suspended from above. Medical advantages: the suspended position of the pelvis is considered one of the most advantageous positions. Cf 6C.

I claim:

1. A parturition bed, comprising:

a main stay;

a main supporting part cantilevered from the main stay and defining a free space below the main support part and having a pelvis support portion and an adjustable height;

a leg supporting part, the heights of the main supporting part and the leg supporting part being adjustable relative to each other from a mutually common lying plane located at a predetermined specified height into separate planes approximately parallel to the mutually common lying plane; and a leg support adjustment mechanism for raising and lowering the leg supporting part;

wherein the leg supporting part, in a lowered position relative to the main supporting part is displaceable in a longitudinal direction of the parturition bed into the free space below the main supporting part, at least to a position where a portion of the leg supporting part is underneath the pelvis supporting portion of the main supporting part.

2. A parturition bed in accordance with claim 1, wherein the main supporting part and leg supporting part each are adjustable in height steplessly.

3. A parturition bed in accordance with claim 1 further comprising a beam rigidly attached to the mainstay and supporting the main supporting part, the main supporting part being raised, lowered, and inclined, in relation to the beam.

4. A parturition bed in accordance with claim 3, wherein the leg supporting part, in a lowered position, can be moved underneath the beam supporting the main supporting part.

5. A parturition bed in accordance with claim 1, wherein the main supporting part can be inclined at various angles.

6. A parturition bed in accordance with claim 1, wherein the main supporting part comprises a back section and a pelvis section the back section and the pelvis section each being separately adjustable to various inclinations.

7. A parturition bed in accordance with claim 3, further comprising a guide rail along which the leg supporting part can be moved, and extending from the main stay in a longitudinal direction of the beam.

8. A parturition bed in accordance with claim 1, further comprising a separate supporting frame for the leg supporting part, wherein the leg supporting part is detachable from the main supporting part, the separate supporting frame being independent of the main stay of the main supporting part.

9. A parturition bed in accordance with claim 1, wherein a side of the leg supporting part facing the main supporting part is equipped with a convex, protruding section that fits into a corresponding concave indentation of the main supporting part when the main supporting part and leg supporting part are arranged at substantially the same height level.

10. A parturition bed in accordance with claim 1, further comprising a detachable rest for attachment to a head end of the main supporting part, and to a foot end of the leg supporting part.

11. A parturition bed in accordance with claim 1, further comprising hand-grips and leg rests disposed adjacent to the main supporting part.

12. A parturition bed in accordance with claim 7, further comprising guide rollers provided on the leg supporting part for moving the leg supporting part along the guide rail.

13. A parturition bed in accordance with claim 8, wherein the leg supporting part is supported on the floor by supporting rollers mounted on the supporting frame.

14. A parturition bed in accordance with claim 13, wherein the supporting rollers are pivoting rollers that can be locked in place.

15. A parturition bed in accordance with claim 1, wherein both the main supporting part and the leg supporting part are equipped with a separate, electrically operated hydraulic unit for adjusting the supporting parts.

16. A parturition bed in accordance with claim 3, further comprising an underframe for adjustably holding the main supporting part for raising, lowering, and inclining the main supporting part in relation to the beam.

17. A parturition bed in accordance with claim 7, wherein the guide rail functions as a power supply line for supplying power to the adjustment mechanism of the leg supporting part.

18. A parturition bed in accordance with claim 1, further comprising:

a strut, which can optionally be attached to the head end of the main supporting part; and a hanging hand grip suspended from the strut.

* * * * *